US011426014B1

(12) United States Patent
Bagley, Sr. et al.

(10) Patent No.: US 11,426,014 B1
(45) Date of Patent: Aug. 30, 2022

(54) BEDDING WITH PERSONAL FLAPS

(71) Applicants: Samuel Bagley, Sr., Atlanta, GA (US); Margo Andrea Bagley, Atlanta, GA (US)

(72) Inventors: Samuel Bagley, Sr., Atlanta, GA (US); Margo Andrea Bagley, Atlanta, GA (US)

( * ) Notice: Subject to any disclaimer, the term of this patent is extended or adjusted under 35 U.S.C. 154(b) by 0 days.

(21) Appl. No.: 17/670,752

(22) Filed: Feb. 14, 2022

Related U.S. Application Data

(60) Provisional application No. 63/151,288, filed on Feb. 19, 2021.

(51) Int. Cl.
*A47G 9/02* (2006.01)
*A47G 9/00* (2006.01)

(52) U.S. Cl.
CPC ..... *A47G 9/0238* (2013.01); *A47G 9/023* (2013.01); *A47G 9/02* (2013.01); *A47G 9/0207* (2013.01)

(58) Field of Classification Search
CPC ..... A47G 9/0238; A47G 9/02; A47G 9/0207; A47G 9/023
USPC ..... 5/494, 482, 486, 502
See application file for complete search history.

(56) References Cited

U.S. PATENT DOCUMENTS 1,885,558 A * 11/1932 Smith ..... A47D 15/008 2/69.5
2,062,611 A * 12/1936 Rosenthal ..... A47D 15/008 5/494
2,689,961 A * 9/1954 Lieberthal ..... A47G 9/023 5/486
2,730,728 A * 1/1956 Roberts ..... A47G 9/023 5/486
3,072,776 A * 1/1963 Quenneville ..... A47G 9/023 5/486
4,005,499 A * 2/1977 Klein ..... A47G 9/023 5/486
D267,696 S 1/1983 Adams
4,802,251 A * 2/1989 O'Dell ..... A47G 9/02 5/494
5,023,969 A 6/1991 Nattrass
(Continued)

FOREIGN PATENT DOCUMENTS

CN 106724479 A 5/2017

OTHER PUBLICATIONS

Ervèt Bedding, "A Two-Duvet Bedding System Designed for Couples," https://www.kickstarter.com/projects/ervet/ervet-a-two-duvet-bedding-system-designed-for-coup, Sep. 2020, 36 pages.

*Primary Examiner* — Robert G Santos
(74) *Attorney, Agent, or Firm* — Edell, Shapiro & Finnan, LLC

(57) ABSTRACT

Presented herein is an article of bedding, which includes a body portion and a flap portion. The body portion includes a substantially elongated member configured to cover, or be covered by, at least a first portion of each of one or more users' bodies. The flap portion includes at least one other member configured to cover, or be covered by, at least a second portion of each user's body. For example, the flap portion can extend along a top portion of the user's body when the body portion extends along a bottom portion of the user's body. The flap portion defines one or more sets of one or more flaps, which may be selectively wrapped and unwrapped around at least part of the second portion of each user's body.

20 Claims, 13 Drawing Sheets

(56) References Cited

U.S. PATENT DOCUMENTS 5,943,717 A * 8/1999 Alexander ..... A47G 9/023 5/482
D428,750 S 8/2000 Chatelain
6,226,814 B1 * 5/2001 Alexander ..... A47G 9/023 5/923
6,237,171 B1 5/2001 Allen
6,311,347 B1 11/2001 Limardi et al.
6,341,396 B1 * 1/2002 Carapezza ..... A47G 9/023 5/482
6,643,871 B1 * 11/2003 Robke ..... A47G 9/0223 5/482
6,698,043 B2 * 3/2004 Fabian ..... A47G 9/0284 5/482
6,862,760 B2 * 3/2005 Bradley ..... A47G 9/023 24/72.5
6,968,582 B1 * 11/2005 Barton ..... A47G 9/0238 5/486
7,100,223 B1 * 9/2006 Anthony ..... A47G 9/0238 5/482
D602,300 S 10/2009 Jeska et al.
D715,582 S 10/2014 Mun
9,179,790 B2 * 11/2015 Messina ..... A47G 9/0261
D770,809 S 11/2016 Bryant
D785,371 S 5/2017 Volpe, II
2003/0121100 A1 * 7/2003 Fabian ..... A47G 9/023 5/486
2006/0130234 A1 * 6/2006 Poulin ..... A47G 9/0238 5/486
2008/0104751 A1 5/2008 Friedland
2009/0151072 A1 6/2009 Jones, III
2009/0199336 A1 8/2009 Gentile
2010/0064436 A1 3/2010 Brandt
2011/0252563 A1 * 10/2011 Horstman ..... A47G 9/0207 5/486
2013/0055501 A1 3/2013 Lisboa
2013/0276231 A1 10/2013 Bowyer et al.
2014/0352062 A1 * 12/2014 Messina ..... A47G 9/023 5/495
2015/0342376 A1 * 12/2015 Hallan ..... A47G 9/023 5/486

* cited by examiner

BEDDING WITH PERSONAL FLAPS

CROSS REFERENCE TO RELATED APPLICATION

This application claims priority to U.S. Provisional Patent Application No. 63/151,288, titled "Bedding with Personal Flaps," filed Feb. 19, 2021, the entirety of which is incorporated herein by reference.

TECHNICAL FIELD

The present disclosure relates generally to bedding and, more particularly, to bedding with one or more sets of personal flaps.

BACKGROUND

Among other things, bedding can provide its users with comfort and warmth. It also can be the source of strife for couples sharing a bed. "Tug-of-War" fights are common, with each person trying to secure as much bedding for themselves as possible. For example, many people enjoy the feeling of wrapping themselves in bedding and like to create cocoon-like environments with their bedding. Traditional bedding cannot accommodate this behavior in a co-sleeping environment.

DESCRIPTION OF EXAMPLE EMBODIMENTS

Overview

Figure 1:
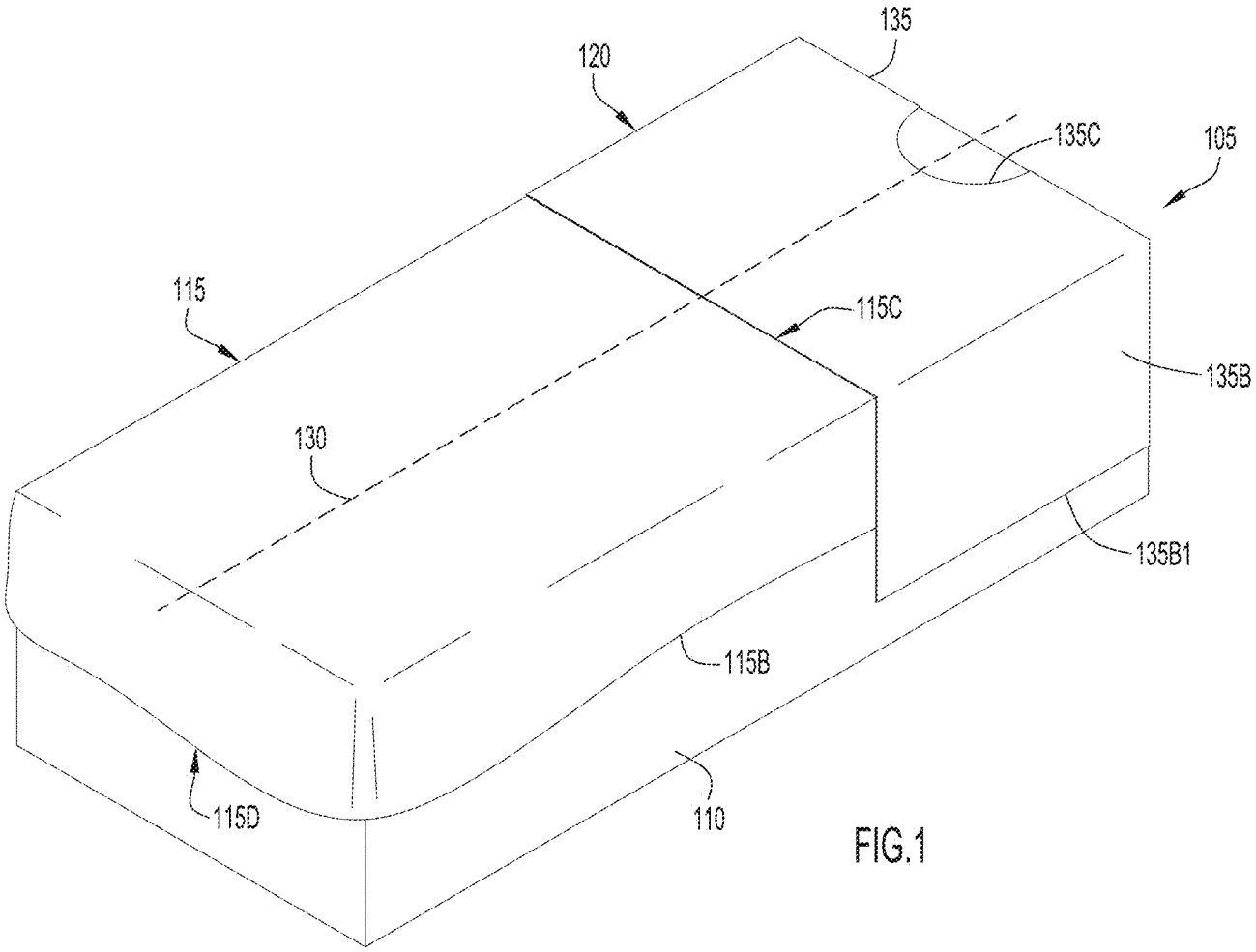
FIG. 1 is a perspective view of bedding, which includes a set of flaps, positioned on a bed, according to an example embodiment.

An article of bedding includes a body portion and a flap portion. The body portion includes a substantially elongated member configured to cover, or be covered by, at least a first portion of a user's body. For example, a length of the body portion can define a plane and/or an axis configured to extend along a length of the user's body when the user is covered by (e.g., by laying under), or covering (e.g., by laying on), the bedding. The flap portion includes another member configured to cover, or be covered by, at least a second portion of the user's body. For example, the flap portion can extend along a top portion of the user's body when the body portion extends along a bottom portion of the user's body. Configurations of the body portion and flap portion, including their respective sizes, shapes, and features, may vary widely.

In an example embodiment, the flap portion defines one or more sets of one or more flaps. For example, one or more ends of the flaps may extend generally away from the axis defined by the body portion. Each of the sets of flaps is configured to be selectively wrapped (and unwrapped) around at least the second portion of the user's body. In this context, a "flap" is any member or portion thereof that is configured to be selectively wrapped and unwrapped relative to a user's body (or portion thereof). For example, the flap portion of the bedding can be arranged to be disposed substantially along, under, over, and/or around the top portion of the user's body, while the body portion of the bedding can be arranged to be disposed substantially along, under, over, and/or around the bottom portion of the user's body. Thus, the flap portion can allow the user to wrap the second portion of their body in the bedding without sacrificing bedding coverage for the first portion of their body or depriving a sleeping partner of bedding coverage.

In an example embodiment, the flap portion includes a single set of flaps configured to be selectively wrapped around the second portion of a single user's body. In an alternative example embodiment, the flap portion includes multiple sets of flaps that are each configured to be selectively wrapped around the second portion of a respective one of a plurality of users' bodies. For example, when multiple users share the bedding, each user may have their own respective set of flaps that they can selectively wrap around the second portion of their body without sacrificing bedding coverage for the first portion of their body and without sacrificing an ability of the other user to enjoy a desired amount of bedding coverage for (the first portion and second portion of) the other user's body. Thus, the bedding may enable each user to enjoy a cocoon-like environment, even in a co-sleeping arrangement. The flap portion also may provide a personal barrier between the co-sleepers, potentially providing increased privacy and/or a sanitary shield as appropriate.

In an example embodiment, the flap portion and/or one or more of the flaps and/or sets of flaps, as applicable, may be selectively removable from the bedding. For example, a user may remove and replace the flap portion, flaps, and/or sets of flaps for washing, hygiene, customization, or other purposes. In a hotel, hospital, guest, or other setting outside of a user's regular sleeping environment, for example, a user might choose (for personal comfort, hygiene, or other reasons) to customize a provided bedding article by removing a flap and repositioning a remaining flap, or replacing a flap portion and/or one or more flaps and/or sets of flaps with their own, selected flap portion, flaps, and/or or sets of flaps, as applicable.

Example Embodiments

Figure 2:
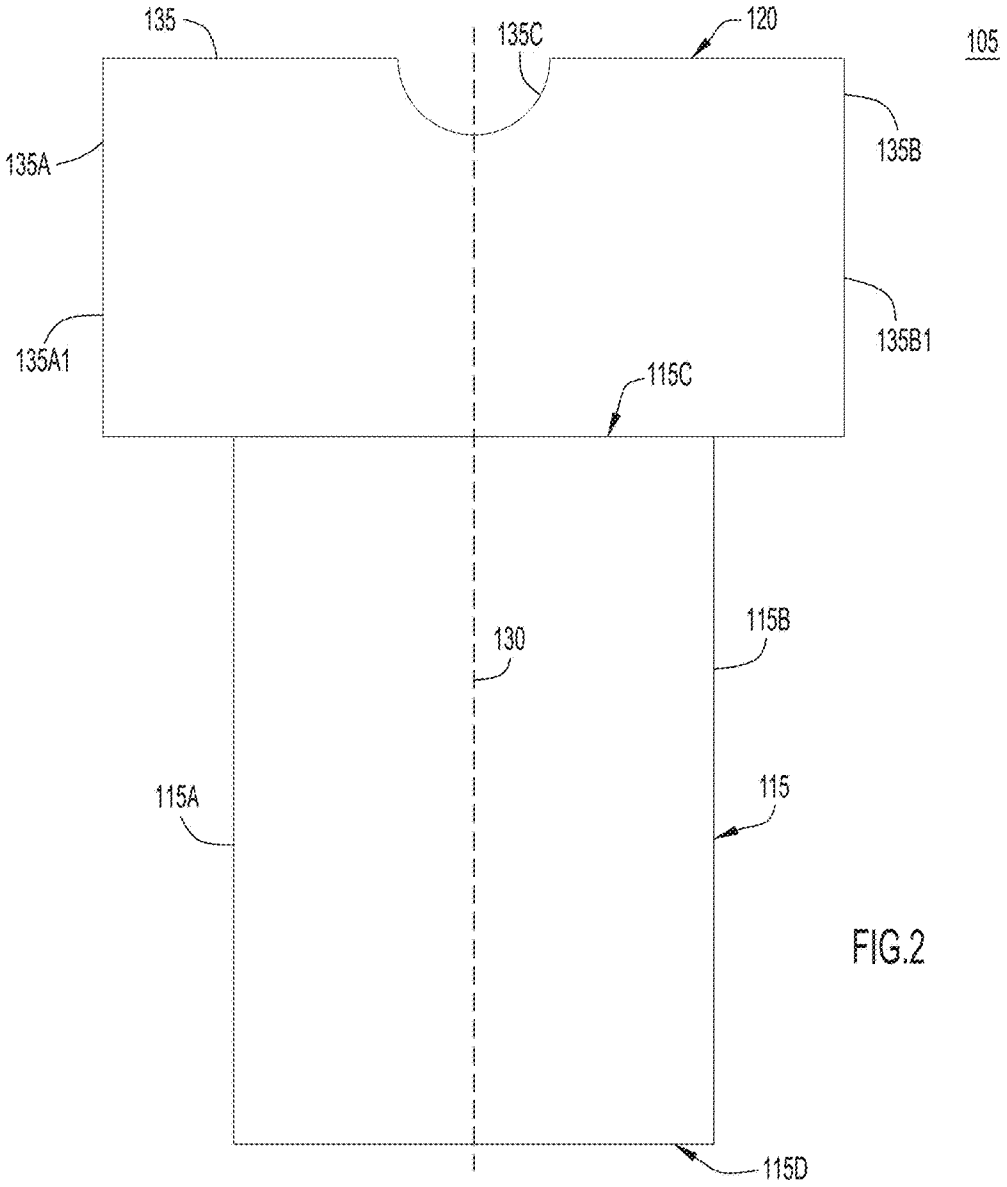
FIG. 2 is a top plan view of the bedding of FIG. 1, according to an example embodiment.

Referring first to FIG. 1, an article of bedding 105 will be described in accordance with an example embodiment. FIG. 2 is a top plan view of the bedding 105, according to an example embodiment. FIGS. 1 and 2 are described together for ease of description.

The bedding 105 includes any material configured to be laid on, under, or within, such as a bed sheet (flat, fitted, or otherwise), blanket, duvet, comforter, quilt, sleeping bag, wearable blanket, or other article. The bedding 105 can be formed from any of a variety of different materials or combinations (e.g., blends) of materials now known or hereinafter developed, such as cotton, silk, polyester, wood (e.g., bamboo fibers), flannel, rayon, etc. The bedding 105 may be, but does not necessarily have to be, sized or otherwise configured to be positioned on a bed 110. For example, the bedding 105 may have a size and/or shape generally corresponding to a mattress and/or bed having a standard twin, extra-long twin, full, queen, king, California king, or other configuration. Alternatively, the bedding 105 may have a size and/or shape independent of any mattress or bed configuration, e.g., for use while lounging on a chair, sofa, futon, or otherwise.

The bedding 105 includes a body portion 115 and a flap portion 120. The body portion 115 includes a substantially elongated member configured to cover, or be covered by, at least a first portion of at least one user's body. A length of the body portion 115 defines an axis 130 (e.g., a central axis of the body portion 115). For example, the axis 130 may extend along, or substantially parallel to, a length of a user's body when the user is laying on the bed 110, at least partially covered by, or covering, the bedding 105.

The flap portion 120 includes an elongated member 135 defining a set of flaps 135A and 135B with ends 135A1 and 135B1, respectively, extending generally away from the axis 130. For example, a width of the flap portion 120 may be larger than a width of the body portion 115 so that ends 135A1 and 135B1 of the flaps 135A and 135B, respectively, extend beyond corresponding side edges 115A and 115B, respectively, of the body portion 115 (relative to the axis 130). The flaps 135A and 135B are configured to be selectively wrapped around a second portion of a user's body. For example, a user can rest their head in/along an optional opening 135C defined by the member 135 and wrap (and unwrap) their face, head, neck, shoulders, and/or another portion of their body with one or more of the flaps 135A and 135B as desired. Use of the body portion 115 and flap portion 120 is described in more detail with reference to FIGS. 3-5 described below.

The body portion 115 and flap portion 120 can be coupled to one another and/or integrally formed together. For example, each of the body portion 115 and flap portion 120 may be formed from one or more different materials, with the materials of the body portion 115 and flap portion 120 being coupled together on at least one edge 140 (FIG. 3) via one or more stitches/seams, rivets, buttons, zippers, pins, buckles, snaps, hooks, buckles, or other fastening mechanisms, which are now known or hereinafter developed. Alternatively, at least one of the materials forming the body portion 115 may overlap with at least one of the materials forming the flap portion 120, at the edge 140, such that the body portion 115 and flap portion 120 are integrally formed (e.g., without any stitches/seams or other fastening mechanisms coupling the body portion 115 and flap portion 120 together).

As would be recognized by a person of ordinary skill in the art, the configurations of the body portion 115 and flap portion 120, including respective sizes, shapes, and features of the body portion 115 and flap portion 120, are illustrative and should not be construed as being limiting in any way. For example, while each of the body portion 115 and the flap portion 120 has a substantially rectangular shape, with side edges 115A and 115B disposed opposite the axis 130 and extending substantially between a top end 115C and a bottom end 115D of the body portion 115, a length (or width) of the flap portion 120 (defined by ends 135A1 and 135B1) being substantially perpendicular to a length of the body portion 115 (defined by top end 115C and bottom end 115D), the width of the flap portion 120 being larger than the width of the body portion 115 (defined by side edges 115A and 115B), and two substantially symmetrical flaps 135A and 135B with ends 135A1 and 135B1 disposed opposite an opening 135C, it should be recognized that the body portion 115 and flap portion 120 may have any of a variety of different shapes, which may be the same as, or different from, one another, there may be more or less than two flaps 135A and 135B, the flaps 135A and 135B and ends 135A1 and 135B1 may or may not be symmetrical, the width of the flap portion 120 may or may not be larger than the width of the body portion 115, and there may or may not be an opening 135C. For example, a shape and/or size of the flap portion 120 may be modified to include an arced, scalloped, or other profile.

Figure 3:
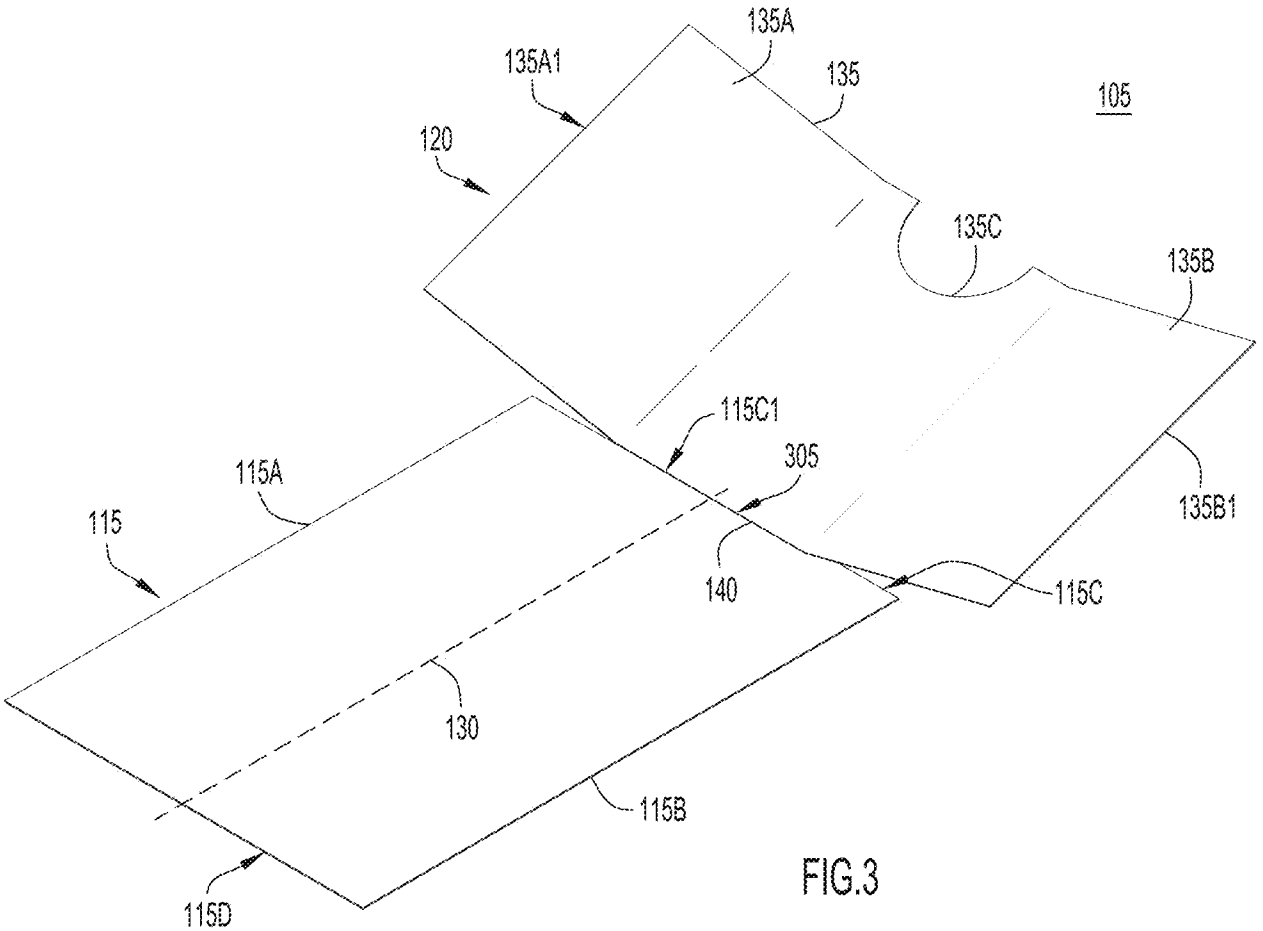
FIG. 3 is a front perspective view of the bedding of FIG. 1, with the flaps of the bedding arranged in an elevated position, according to an example embodiment.

FIG. 3 is a front perspective view of the bedding 105, with the set of flaps 135A and 135B arranged in an elevated position, according to an example embodiment. In particular, the ends 135A1 and 135B1 of the flaps 135A and 135B have been lifted upward relative to a plane defined by the body portion 115, substantially along at least a middle portion 115C1 of the top end 115C (e.g., at the edge 140), and inward towards a center of the flap portion 120 (e.g., towards the opening 135C). For example, a user laying on or under the bedding 105 may adjust positions of the flaps 135A and 135B to cause the flaps 135A and 135B to move between a regular, flat position (e.g., the position depicted in FIG. 1) and the elevated position depicted in FIG. 3, or another position, such as a wrapped position.

As shown in FIG. 3, the set of flaps 135A and 135B includes a middle portion 305, that is attached, or integral, to the middle portion 115C1 of the top end 115C of the body portion 115 (e.g., at the edge 140) and disposed substantially between the ends 135A1 and 135B1. Each of the ends 135A1 and 135B1 is unattached to the body portion 115, allowing freedom of movement by the ends 135A1 and 135B1 relative to the body portion 115. It should be appreciated that the configuration depicted in FIG. 3 is illustrative and alternative configurations may be included in other example embodiments. For example, the length of the middle portion 305 that is attached, or integral, to the middle portion 115C1 may be larger or smaller in alternative embodiments.

Figure 4:
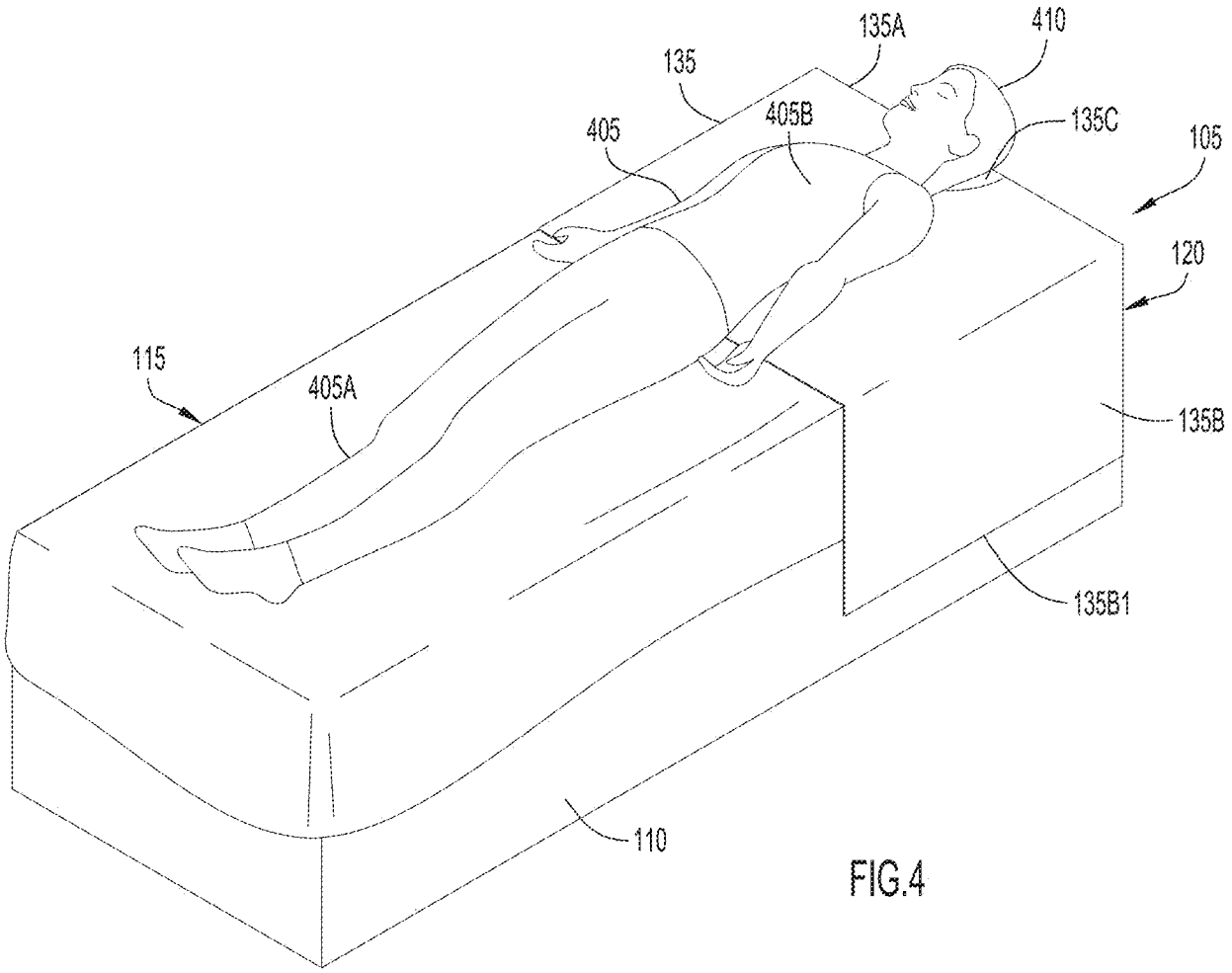
FIG. 4 is a perspective view of a user laying on a bed with flaps of the bedding of FIG. 1 arranged in non-wrapped (or "unwrapped") positions, according to an example embodiment.

FIG. 4 is a perspective view of a user 405 laying in the bed 110 with flaps 135A and 135B of the bedding 105 arranged in non-wrapped (or "unwrapped") positions, according to an example embodiment. With reference to FIGS. 1-4, the user 405 is laying on the bedding 105, with a first (bottom) portion 405A of the user 405 laying on/along the body portion 115 of the bedding 105, and a second (top) portion 405B of the user 405 laying on/along the flap portion 120 of the bedding 105. A head 410 of the user 405 is disposed substantially within/along the opening 135C defined by the member 135. Ends 135A1 and 135B1 of the flaps 135A and 135B, respectively, are disposed along sides of the bed 110. The user 405 can adjust a position of one or both of the flaps 135A and 135B, e.g., by lifting the ends 135A1 and 135B1 and/or one or more other portions of the flaps 135A and 135B. For example, the user 405 can wrap at least part of the top portion 405B of their body (e.g., their face, head, neck, and/or shoulders) with one or both of the flaps 135A and 135B.

Figure 5:
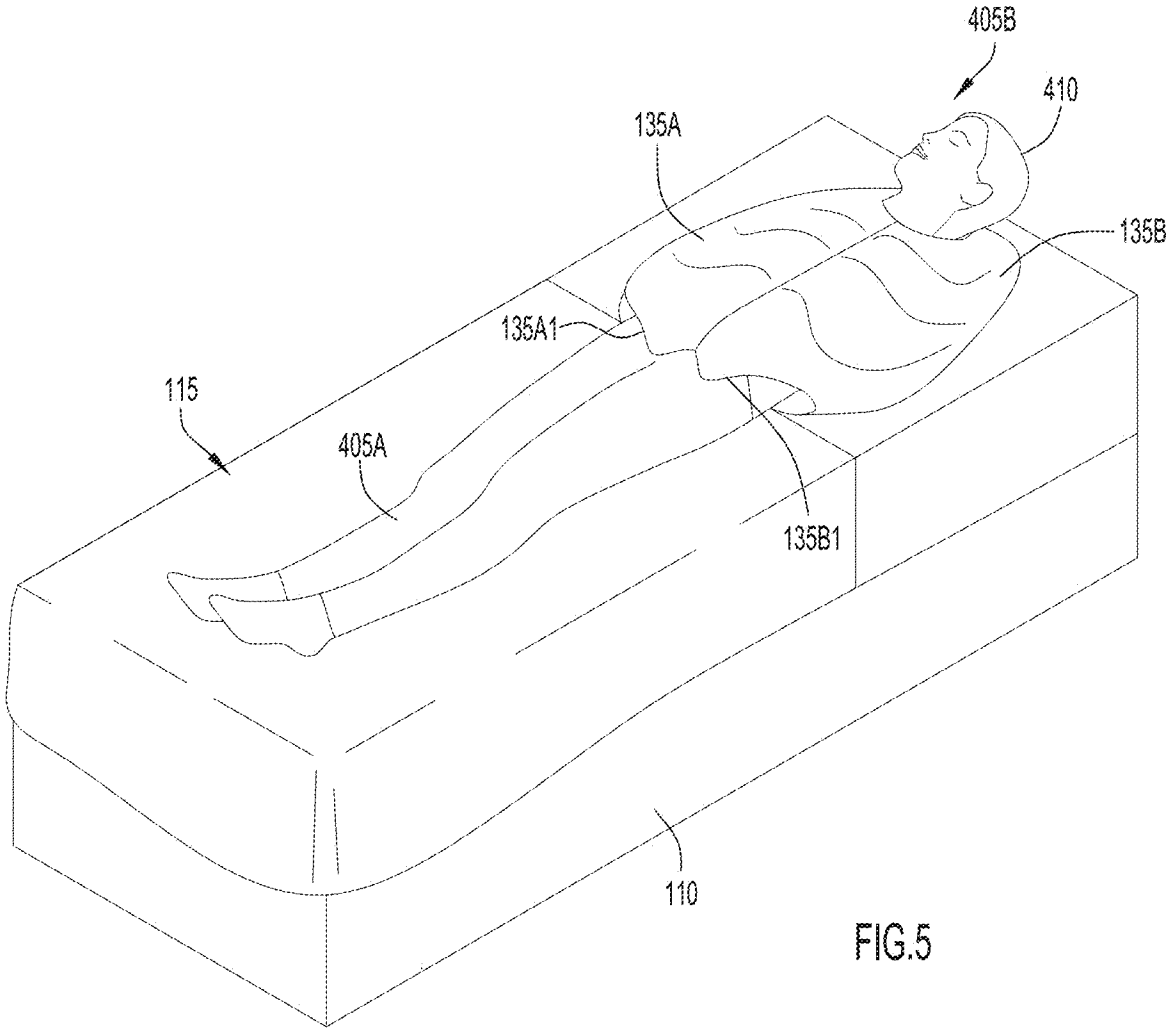
FIG. 5 is a perspective view of a user laying on a bed with flaps of the bedding of FIG. 1 arranged in wrapped positions, according to an example embodiment

FIG. 5 is a perspective view of the user 405 laying in the bed 110, with the flaps 135A and 135B of the bedding 105 arranged in wrapped positions, according to an example embodiment. In the wrapped positions, the flaps 135A and 135B are wrapped at least partially around at least part of the top portion 405B of the user's body. For example, the flaps 135A and 135B can be draped around the user's face, head, neck, and/or shoulders, with ends 135A1 and 135B1 of the flaps 135A and 135B, respectively, positioned along or towards the bottom portion 405A of the user's body. The ends 135A1 and 135B1 also may be tucked under the body of the user 405 and/or a blanket or other bedding material (not shown), for example.

It should be appreciated that the (flat, elevated, wrapped, and unwrapped) positions depicted in the figures and described herein are illustrative. Many other positions enabled by the bedding 105 will be apparent to a person of ordinary skill in the art. For example, while FIG. 5 shows both of the flaps 135A and 135B in wrapped positions, it should be appreciated that the user 405 may selectively wrap and unwrap one, both, or neither of the flaps 135A and 135B above or beneath the user 405 as desired, while resting face up, face down, on a side, or in another position. Moreover, while FIGS. 4 and 5 show the user 405 laying on the bedding 105, with the bottom portion 405A of the user resting on/along the body portion 115 of the bedding 105 and the top portion 405B of the user resting on/along the flap portion 120, it should be appreciated that the user 405 may lay in any of a variety of different positions, whether on or under the bedding 105. For example, the user 405 may lay substantially under the bedding 105, with the flap portion 120 wrapping over and/or around at least part of the top portion 405B of the user, similar to the embodiment depicted in FIG. 11 described below. In addition, or in the alternative, the bedding 105 can include a pocket (e.g., in the body portion 115) configured for the user 405 to sleep under/within the body portion 115 (e.g., similar to a sleeping bag) while resting on and/or wrapped at least partially within one or both of the flaps 135A and 135B.

Figure 6:
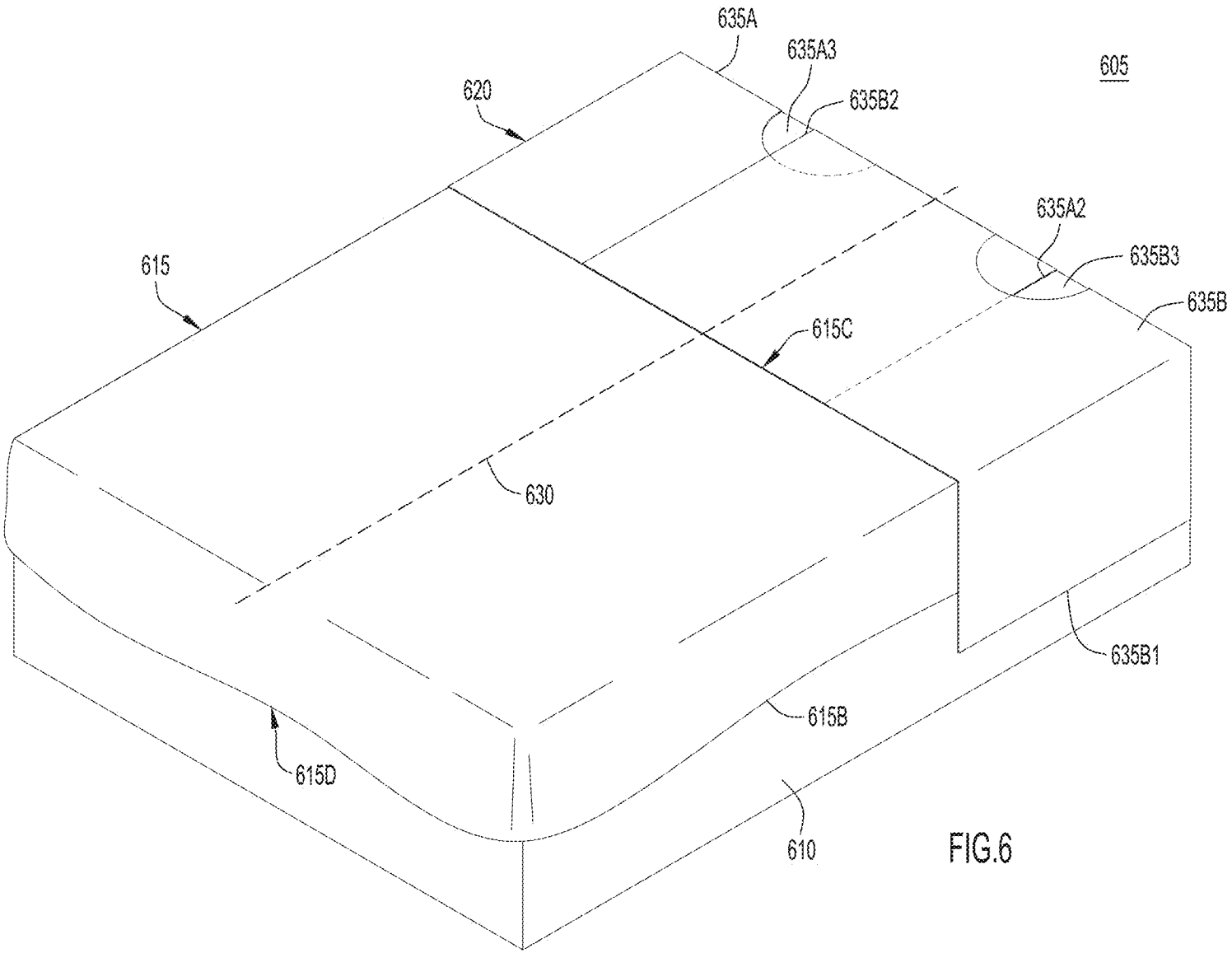
FIG. 6 is a perspective view of bedding, which includes multiple sets of flaps, positioned on a bed, according to an alternative example embodiment.
Figure 7:
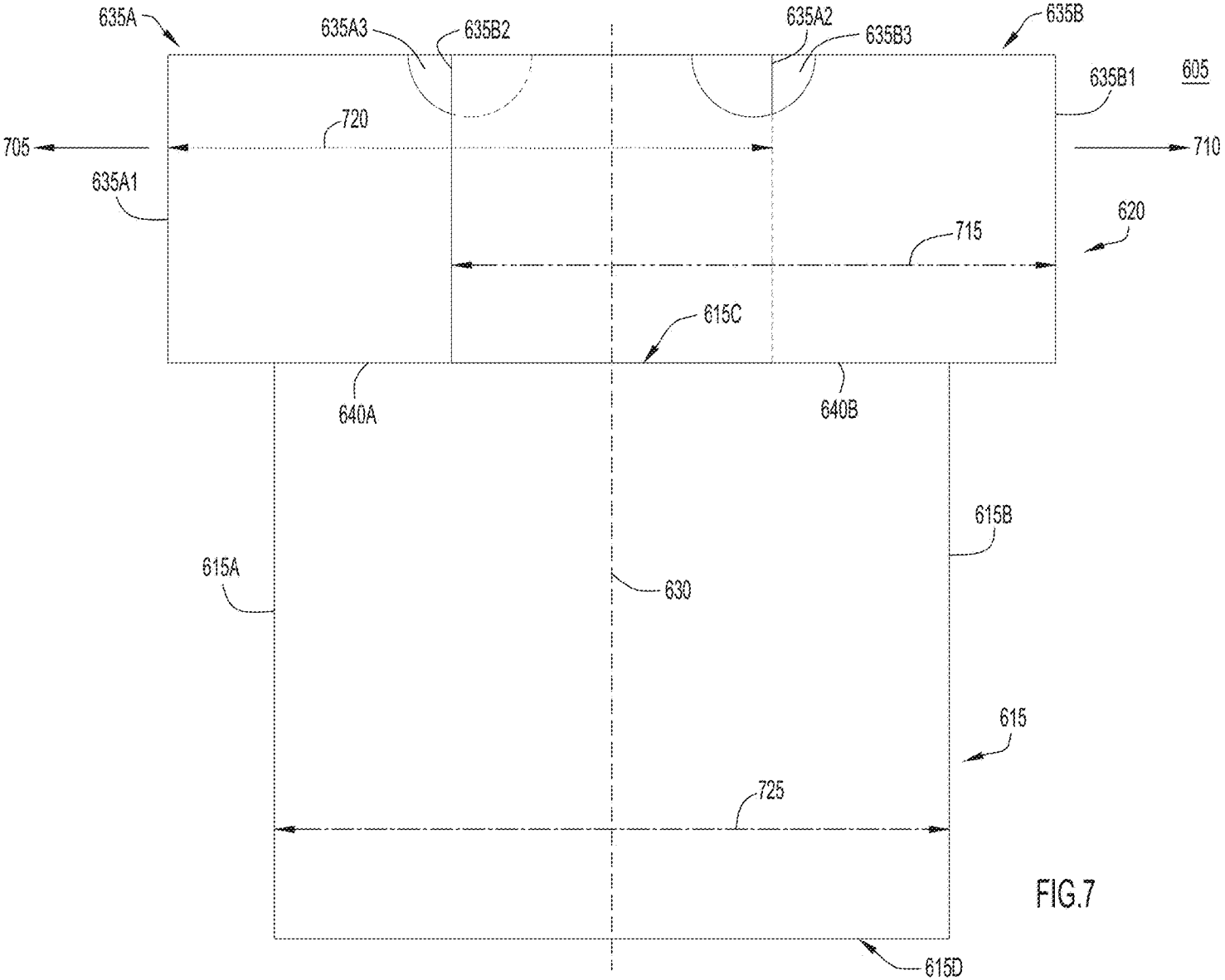
FIG. 7 is a top plan view of the bedding of FIG. 6, according to an example embodiment.

FIG. 6 is a perspective view of an article of bedding 605 according to an alternative example embodiment. FIG. 7 is a top plan view of the bedding 605, according to an example embodiment. FIGS. 6 and 7 are described together for ease of description.

The bedding 605 is substantially similar to the bedding 105 described above with reference to FIGS. 1-5, except that the bedding 605 includes multiple sets of flaps 635A and 635B. For example, the bedding 605 can be configured to be used by two or more users, with each user having their own respective one of the sets of flaps 635A and 635B. The bedding 605 may, e.g., have a size and/or shape generally corresponding to a mattress and/or bed 610 configured for two or more users, such as a full, queen, king, California king, or other configuration. However, it should be appreciated that the bedding 605 may have any size and/or shape, which may correspond to, or be independent of, any mattress or bed configuration.

The bedding 605 includes a body portion 615 and a flap portion 620. The body portion 615 includes a substantially elongated member configured to simultaneously extend substantially along a length of a first portion of a first user's body and a first portion of a second user's body when the first portion of the first user's body and the first portion of the second user's body are covered by, or covering, the body portion 615. The elongated member includes a first side end (or edge) 615A, a second side end (or edge) 615B disposed opposite the first side end 615A, a top end (or edge) 615C, and a bottom end (or edge) 615D disposed opposite the top end 615C. A length of the body portion 615 defines an axis 630 (e.g., a central axis of the body portion 615), which extends through a width of the body portion 615 that is defined by the first side end (or edge) 615A and the second side end (or edge) 615B, between the top end (or edge) 615C and the bottom end (or edge) 615D. For example, the axis 630 may extend along, or substantially parallel to, the length of the first user's body and/or the length of the second user's body when the first user and second user are laying on the bed 610, at least partially covered by, or covering, the bedding 605.

Figure 8A:
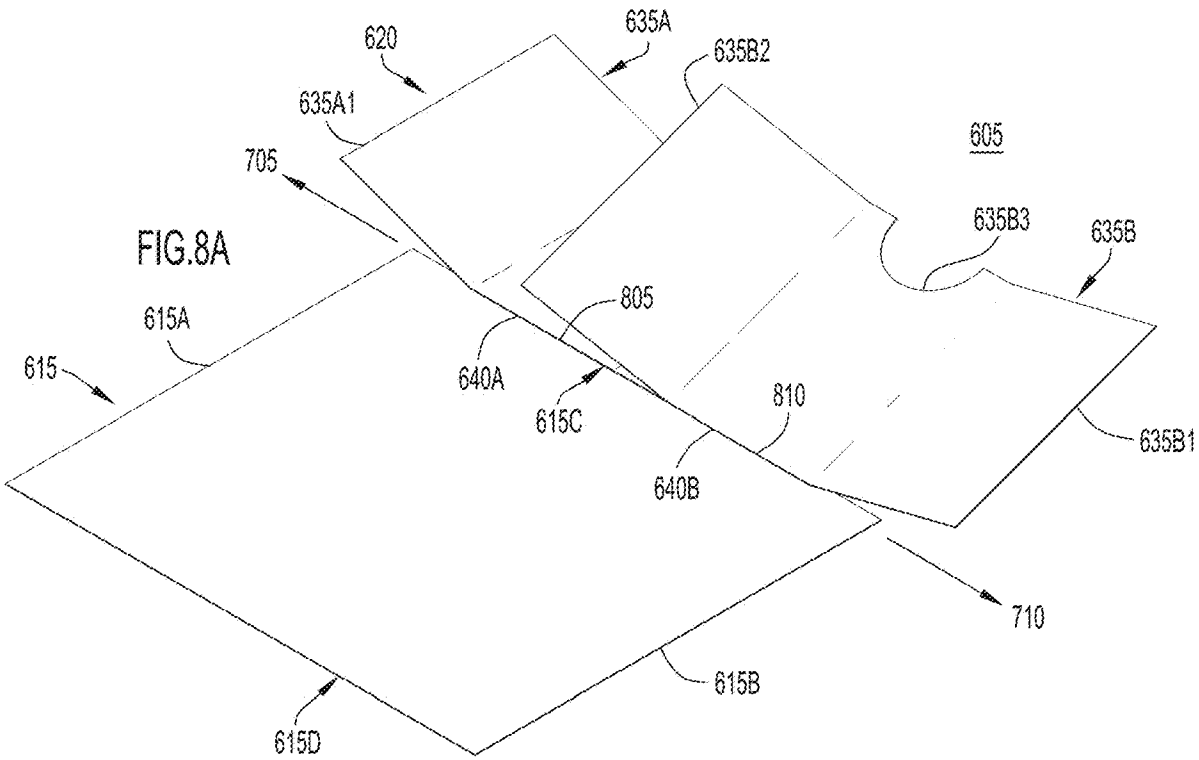
FIG. 8A is a front perspective view of the bedding of FIG. 6, with sets of flaps of the bedding arranged in an elevated position, according to an example embodiment.
Figure 8B:
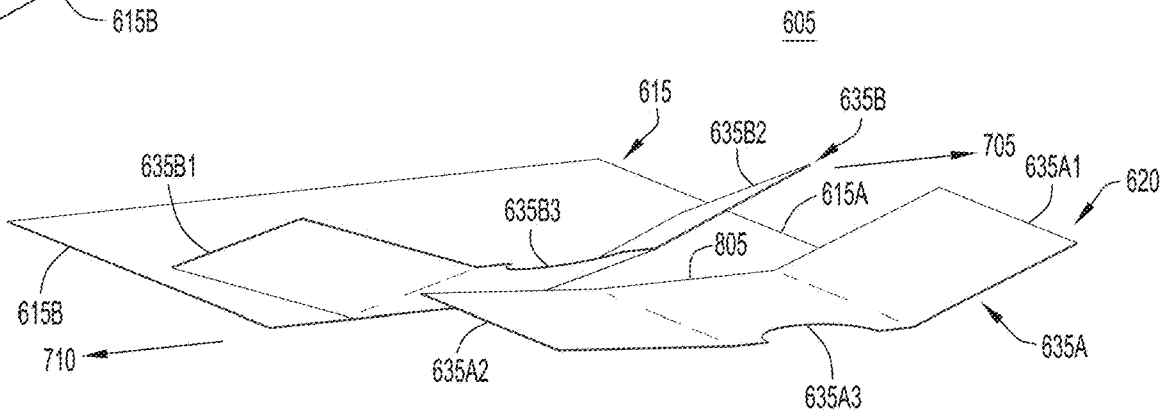
FIG. 8B is a rear perspective view of the bedding of FIG. 6, with sets of flaps of the bedding arranged in an elevated position, according to an example embodiment.

As best seen in FIGS. 8A and 8B, which are described below, the flap portion 620 includes elongated members that each define a set of flaps, namely set 635A and set 635B, extending generally from the top end 615C of the body portion 615. Set 635A includes a first flap with an end 635A1 and a second flap with an end 635A2 disposed on opposite sides of an opening 635A3. The ends 635A1 and 635A2 extend away from the opening 635A3, with the end 635A1 extending substantially away from the axis 630 in a first direction 705 (FIG. 7) so that an edge of the end 635A1 is disposed beyond a corresponding side end (or edge) 615A of the body portion 615 (relative to the axis 630), where the side end (or edge) 615A also extends substantially away from the axis 630 in the first direction 705. An edge of the end 635A2 extends substantially away from the axis 630 in a second direction 710 (FIG. 7) opposite the first direction. Set 635B includes a first flap with an end 635B1 and a second flap with an end 635B2 disposed on opposite sides of an opening 635B3. The ends 635B1 and 635B2 extend away from the opening 635B3, with the end 635B1 extending substantially away from the axis 630 in the second direction 710 so that an edge of the end 635B1 is disposed beyond a corresponding side end (or edge) 615B of the body portion 615 (relative to the axis 630), where the side end (or edge) 615B also extends substantially away from the axis 630 in the second direction 710. An edge of the end 635B2 extends substantially away from the axis 630 in the first direction 705.

When the sets 635A and 635B are disposed in a regular, flat, unwrapped position (e.g., the position depicted in FIGS. 6 and 7), ends 635A2 and 635B2 overlap one another, with one of the ends being disposed substantially on another of the ends. For example, as shown in FIGS. 6 and 7, end 635B2 can rest on end 635A2, essentially nesting end 635A2 behind end 635B2. Alternatively, end 635A2 can rest on end 635B2, essentially nesting end 635B2 behind end 635A2. The degree of overlap of the sets of flaps 635A and 635B can vary. For example, when set 635B has a flap width 715 defined by ends 635B1 and 635B2, at least ten percent (10%) of that flap width 715 can be covered by set 635A when end 635A2 rests on end 635B2. Similarly, when set 635A has a flap width 720 defined by ends 635A1 and 635A2, at least ten percent (10%) of that flap width 720 can be covered by set 635B when end 635B2 rests on end 635A2. As may be appreciated, more or less than ten percent (10%) of the covered flap width (715 or 720, as applicable) can be covered in alternative example embodiments. For example, as shown in FIG. 7, as much as twenty percent (20%) or more of the covered flap width (715 or 720) can be covered in example embodiments. For example, if each of the flap widths 715 and 720 is about sixty (60) inches, the flaps may overlap by at least six (6) inches, at least twelve (12) inches, or another amount.

Each of the sets 635A and 635B (and each of the flaps thereof) is configured to be selectively wrapped around a second portion of a user's body. For example, a user can rest their head in/along one of the openings (635A3 or 635B3) and wrap (and unwrap) their face, head, neck, shoulders, and/or another portion of their body with one or more of the flaps defined by a corresponding one of the sets (635A or 635B, as applicable), as desired. In an example embodiment, each of the sets of flaps 635A and 635B has a flap width (720 and 715, respectively) that is more than fifty percent (50%) of a body portion width 725 defined by side end (or edge) 615A and side end (or edge) 615B. For example, each of the flap widths 720 and 715 can be at least fifty-two percent (52%) or at least fifty-five percent (55%)—or some other value larger than fifty percent (50%)—of the body portion width 725. This way, each of the sets of flaps 635A and 635B can be wider than a width of the body portion 615 that may be allocated for use by a respective user (i.e., one-half of the body portion width 725). Thus, not only can each user have their own set of flaps (635A or 635B) with which to wrap themselves, but each of the sets of flaps 635A and 635B can provide even more material for wrapping than the user otherwise would have if the sets of flaps 635A and 635B had the same width as (or a lesser width than) a corresponding half of the body portion 615. For example, if the body portion 615 has a body portion width 725 consistent with a width of a standard king size sheet, i.e., about 108-110 inches, each of the flap widths 720 and 715 may be about sixty (60) to sixty-three (63) inches or some other value that is more than fifty-four (54) to fifty-five (55) inches (i.e., more than one-half the body portion width 725). Use of the body portion 615 and flap portion 620 is described in more detail with reference to FIGS. 8A, 8B, 9, 10, and 11 described below.

The body portion 615 and flap portion 620 can be coupled to one another and/or integrally formed together. For example, each of the body portion 615 and flap portion 620, including each of the sets 635A and 635B, may be formed from one or more different materials, with the materials of the body portion 615 and flap portion 620 being coupled together on one or more edges (e.g., edges 640A and 640B) via one or more stitches/seams, rivets, buttons, zippers, pins, buckles, snaps, hooks, buckles, or other fastening mechanisms, which are now known or hereinafter developed. Alternatively, at least one of the materials forming the body portion 615 may overlap with at least one of the materials forming the flap portion 620 (or one or more of the sets 635A and 635B, e.g., at the edges 640A and 640B), such that the body portion 615 and flap portion 620 are integrally formed (e.g., without any stitches/seams or other fastening mechanisms coupling the body portion 615 and flap portion 620 together).

As would be recognized by a person of ordinary skill in the art, the configurations of the body portion 615 and flap portion 620, including respective sizes, shapes, and features of the body portion 615, flap portion 620, and sets 635A and 635B, are illustrative and should not be construed as being limiting in any way. For example, while each of the body portion 615 and the flap portion 620, including each of the sets 635A and 635B, has a substantially rectangular shape, with a length of each of the sets 635A and 635B (i.e., flap width 720 or flap width 715) being substantially perpendicular to a length of the body portion 615 (defined by top end 615C and bottom end 615D), and substantially symmetrical ends disposed opposite an opening (635A3 or 635B3, as applicable), it should be recognized that the body portion and flap portion 620 may have any of a variety of different shapes, which may be the same as, or different from, one another, the ends of the sets 635A and 635B may or may not be symmetrical, and there may or may not be an opening (635A3 or 635B3). For example, a shape and/or size of the flap portion 620 (and/or one or more of the sets 635A and 635B) may be modified to include an arced, scalloped, or other profile.

FIG. 8A is a front perspective view of the bedding 605, with each of the sets of flaps 635A and 635B arranged in an elevated position, according to an example embodiment. FIG. 8B is a rear perspective view of the bedding 605 of FIG. 8A, according to an example embodiment. FIGS. 8A and 8B are described together for ease of description.

Similar to the flap portion 120 described above with reference to FIG. 3, ends 635A1 and 635A2 of set 635A and ends 635B1 and 635B2 of set 635B have been lifted upward relative to a plane defined by the body portion 615, and inward towards a center (e.g., an opening 635A3 or 635B3, respectively) of the set (635A or 635B, respectively). For example, a first user laying on or under the bedding 605 may adjust positions of the ends 635A1 and 635A2 to cause the set of flaps 635A to move between a regular, flat, unwrapped position (e.g., the position depicted in FIG. 6) and the elevated position depicted in FIGS. 8A and 8B. Similarly, a second user laying on or under the bedding 605 may adjust positions of the ends 635B1 and 635B2 to cause the set of flaps 635B to move between a regular, flat, unwrapped position (e.g., the position depicted in FIG. 6) and the elevated position depicted in FIGS. 8A and 8B, or another position, such as a wrapped position.

As shown in FIGS. 8A and 8B, the set of flaps 635A includes a middle portion 805, that is attached, or integral, to the top end 615C of the body portion 615 (e.g., at the edge 640A) and disposed substantially between the ends 635A1 and 635A2. Each of the ends 635A1 and 635A2 is unattached to the body portion 615, allowing freedom of movement by the ends 635A1 and 635A2 relative to the body portion 615. Similarly, the set of flaps 635B includes a middle portion 810, that is attached, or integral, to the top end 615C of the body portion 615 (e.g., at the edge 640B) and disposed substantially between the ends 635B1 and 635B2. Each of the ends 635B1 and 635B2 is unattached to the body portion 615, allowing freedom of movement by the ends 635B1 and 635B2 relative to the body portion 615. It should be appreciated that the configuration depicted in FIGS. 8A and 8B is illustrative and alternative configurations may be included in other example embodiments. For example, the lengths of the middle portions 805 and 810 that are attached, or integral, to the top end 615C may be larger or smaller in alternative embodiments.

Figure 9:
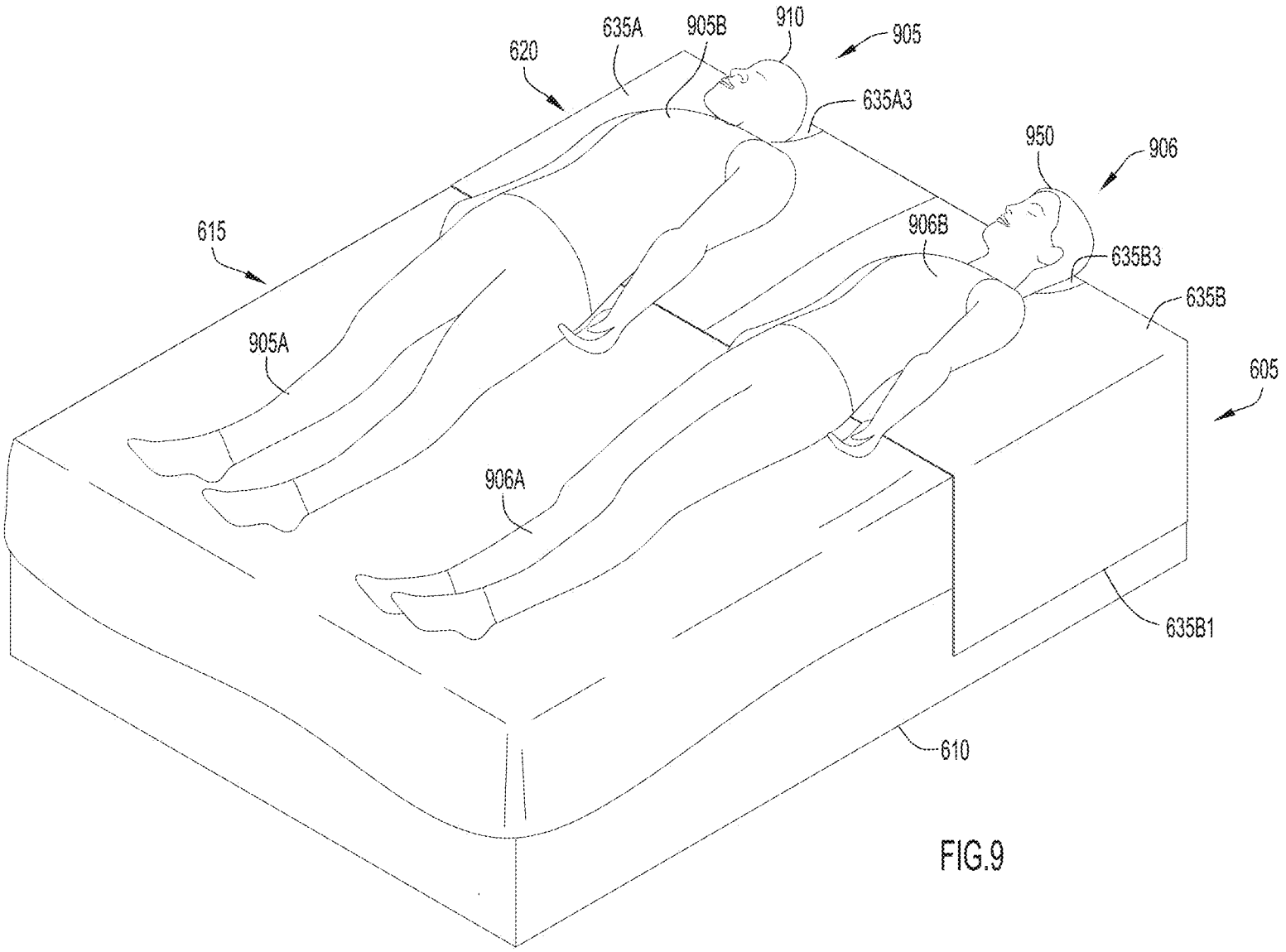
FIG. 9 is a perspective view of multiple users laying on a bed, on/along the bedding of FIG. 6, with flaps of the bedding arranged in non-wrapped (or "unwrapped") positions, according to an example embodiment.

FIG. 9 is a perspective view of multiple users (905 and 906) laying in the bed 610, on/along the bedding 605, with sets of flaps 635A and 635B of the bedding 605 arranged in non-wrapped (or "unwrapped") positions, according to an example embodiment. In particular, a first user 905 is laying on the bedding 605, with a first (bottom) portion 905A of the user 905 laying on/along the body portion 615 of the bedding 605, and a second (top) portion 905B of the user 905 laying on/along the flap portion 620 of the bedding 605. A head 910 of the user 905 is disposed substantially along at least a portion of the opening 635A3 defined by the set of flaps 635A. Similarly, a second user 906 is laying on the bedding 605, with a first (bottom) portion 906A of the user 906 laying on/along the body portion 615 of the bedding 605, and a second (top) portion 906B of the user 906 laying on/along the flap portion 620 of the bedding 605. A head 950 of the user 906 is disposed substantially along at least a portion of the opening 635B3 defined by the set of flaps 635B. Ends 635A1 (FIGS. 6-8) and 635B1 of the sets of flaps 635A and 635B, respectively, are disposed along sides of the bed 610.

Each of the users 905 and 906 can adjust a position of their respective sets of flaps 635A and 635B, respectively, e.g., by lifting one or more of the ends (i.e., end 635A1 or end 635A2 for set 635A; and end 635B1 or 635B2 for set 635B) and/or one or more other portions of the sets 635A and 635B. For example, the user 905 can wrap at least part of the top portion 905B of their body (e.g., their face, head, neck, and/or shoulders) with one or both ends of the set 635A, while the user 906 can wrap at least part of the top portion 906B of their body with one or both ends of the set 635B.

Figure 10:
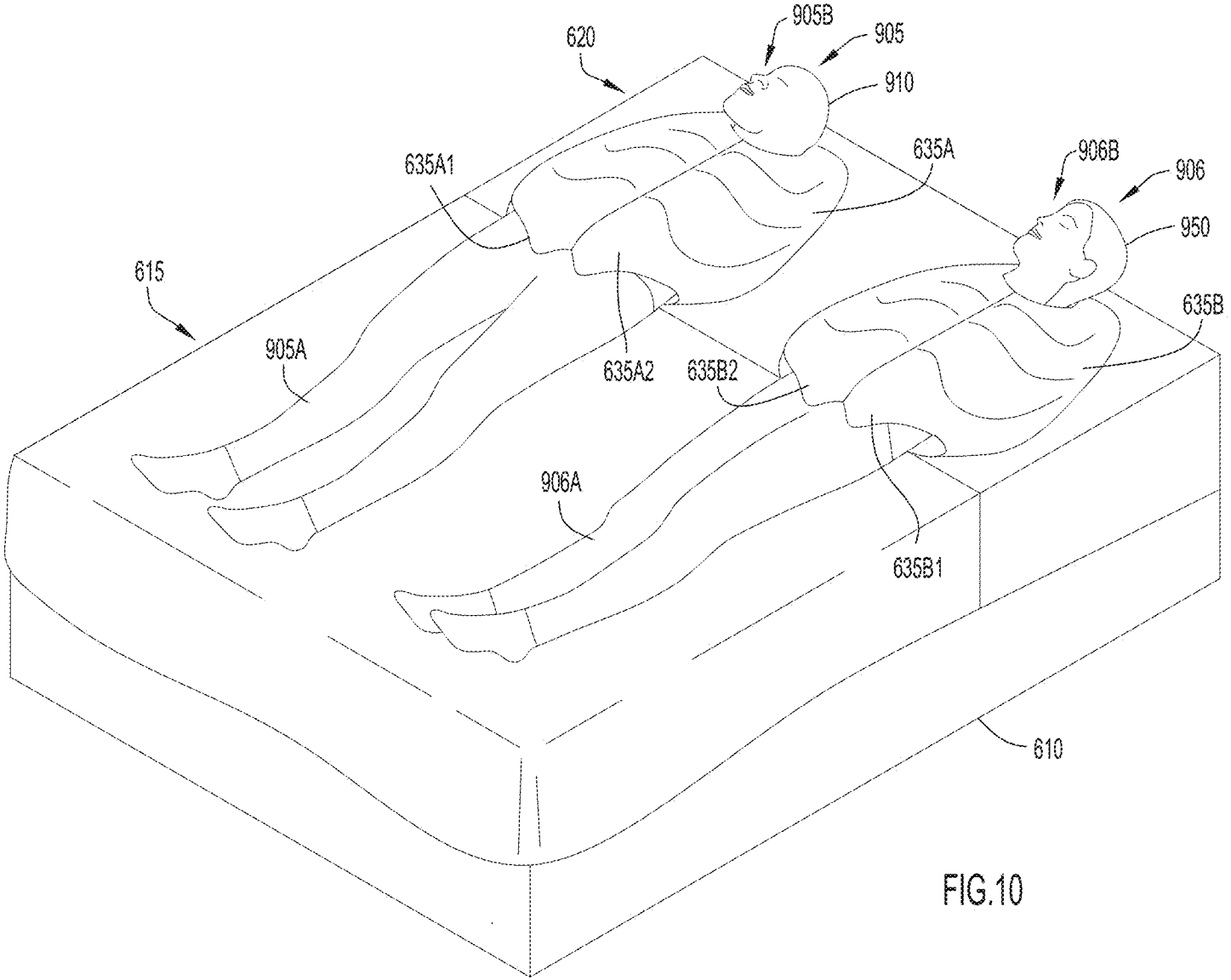
FIG. 10 is a perspective view of multiple users laying on a bed, on/along the bedding of FIG. 6, with flaps of the bedding arranged in wrapped positions, according to an example embodiment.

FIG. 10 is a perspective view of the users 905 and 906 laying in the bed 610, with the sets of flaps 635A and 635B of the bedding 605 arranged in wrapped positions, according to an example embodiment. In the wrapped positions, the ends 635A1 and 635A2 are wrapped at least partially around at least part of the top portion 905B of the body of the user 905, while the ends 635B1 and 635B2 are wrapped at least partially around at least part of the top portion 906B of the body of the user 906. For example, each of the sets of flaps 635A and 635B can be draped around the face, head, neck, and/or shoulders of the user 905 or the user 906, respectively, with ends 635A1, and 635A2 positioned along or towards the bottom portion 905A of the body of the user 905 and ends 635B1 and 635B2 positioned along or towards the bottom portion 906A of the body of the user 906. The ends 635A1, 635A2, 635B1, and 635B2 may be tucked under the body of the user (905 or 906, as applicable) and/or a blanket or other bedding material (not shown), for example.

Figure 11:
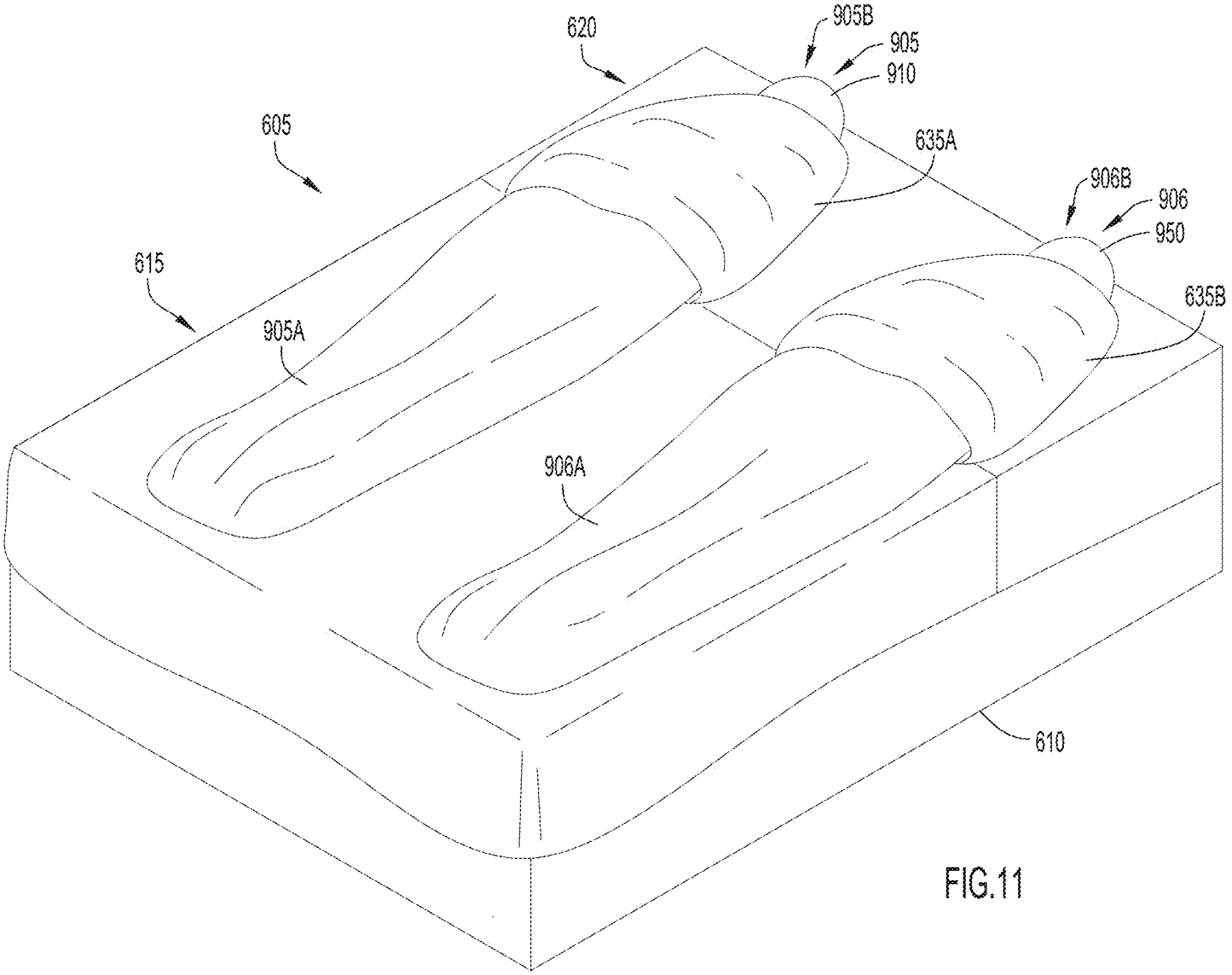
FIG. 11 is a perspective view of multiple users laying on a bed, under the bedding of FIG. 6, with flaps of the bedding arranged in wrapped positions, according to an example embodiment.

It should be appreciated that the (flat, elevated, wrapped, and unwrapped) positions depicted in the figures and described herein are illustrative. Many other positions enabled by the bedding 605 will be apparent to a person of ordinary skill in the art. For example, while FIG. 10 shows both of the sets of flaps 635A and 635B in wrapped positions, it should be appreciated that the users 905 and 906 may selectively wrap and unwrap one, both, or neither of the sets of flaps 635A and 635B, or portions thereof, as desired, while resting face up, face down, on a side, or in another position. Moreover, while FIGS. 9 and 10 show the users 905 laying on the bedding 605, with the bottom portion (905A or 906A) of each user resting on/along the body portion 615 of the bedding 605 and the top portion (905B or 906B) of each user resting on/along the flap portion 620, it should be appreciated that the users 905 and 906 may lay in any of a variety of different positions, whether on or under the bedding 605. For example, FIG. 11 shows a perspective view of multiple users laying on the bed 610, under the bedding 605, with the sets of flaps 635A and 635B arranged in wrapped positions around at least part of the top portions (905B and 906B) of their bodies (905 and 906, respectively), according to an example embodiment. In addition, or in the alternative, the bedding 605 can include a pocket (e.g., in the body portion 615) configured for one or more of the users 905 and 906 to sleep under/within the body portion 615 (e.g., similar to a sleeping bag) while resting on and/or wrapped at least partially within one or both of the sets of flaps 635A and 635B.

Figure 12:
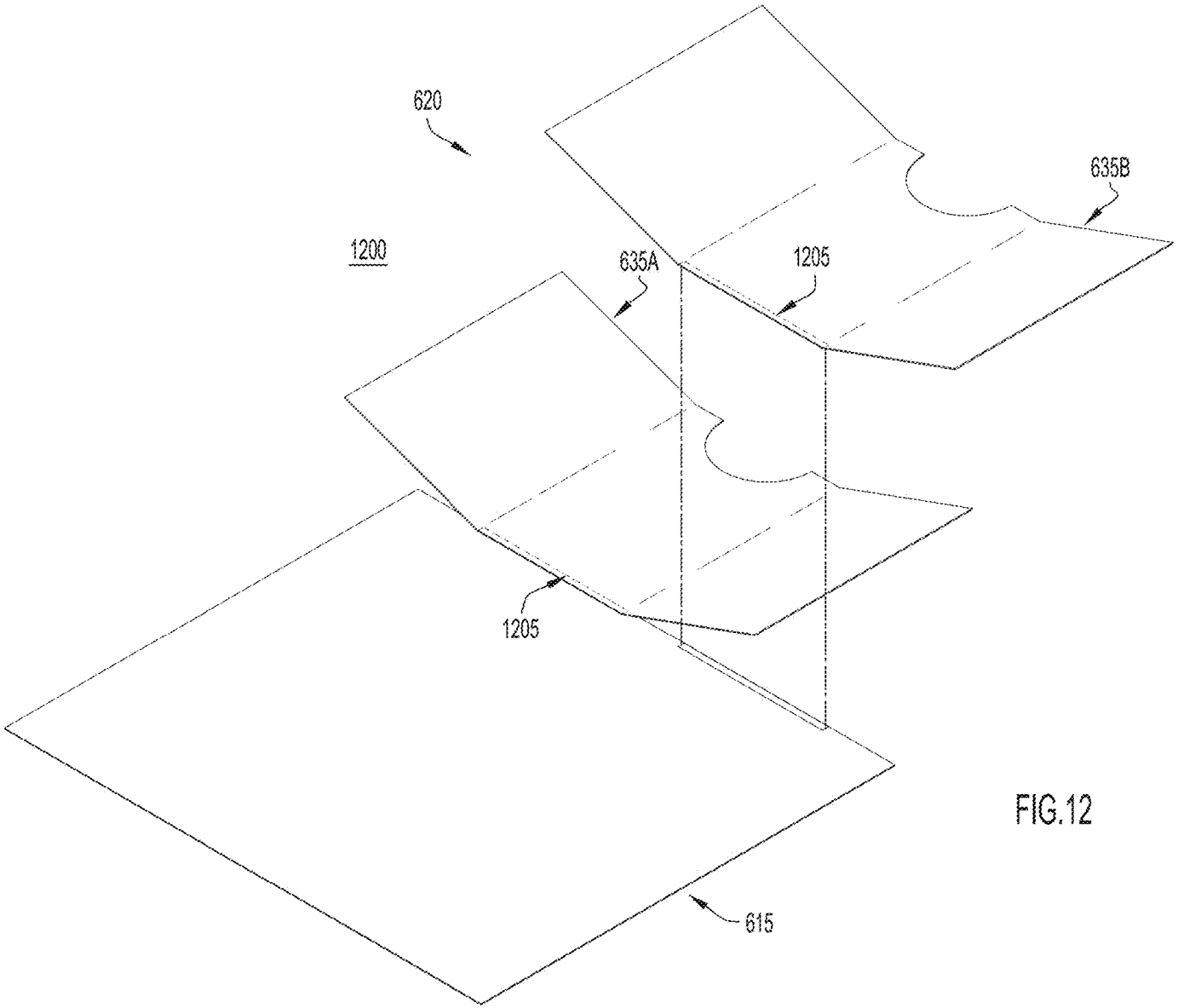
FIG. 12 is a perspective view of bedding, which includes removable flaps, according to an example embodiment.

FIG. 12 is a perspective view of an article of bedding 1200, according to an alternative example embodiment. The bedding 1200 is substantially similar to the bedding 605 described above with reference to FIGS. 6-11, except that the bedding 1200 includes one or more fastening mechanisms 1205, which may be selectively actuated to remove or attach each of the sets of flaps 635A and 635B to the body portion 615 of the bedding 1200. The fastening mechanisms 1205 can include any device or combination of devices for removably attaching material, such as one or more rivets, buttons, zippers, pins, buckles, snaps, hooks, buckles, or other mechanisms now known or hereinafter developed.

For example, a user may use the fastening mechanisms 1205 to remove and replace one or both of the sets of flaps 635A and 635B for washing, hygiene, customization, or other purposes. In a hotel, hospital, guest, or other setting outside of a user's regular sleeping environment, for example, a user might choose (for personal comfort, hygiene, or other reasons) to customize a provided bedding article by removing one set of the flaps (635A or 635B) and repositioning a remaining set of the flaps, or replacing one or both of the sets of flaps 635A and 635B with one or more other sets of flaps. It should be appreciated that the relative positioning of the sets of flaps 635A and 635B and fastening mechanisms 1205 is illustrative and can vary in alternative example embodiments. For example, in an example embodiment, a user can replace the sets of flaps 635A and 635B with a single flap (e.g., one of the removed sets of flaps 635A and 635B or another set of flaps) positioned centrally along the edge between the body portion and the top portion of the bedding 1200.

Figure 13:
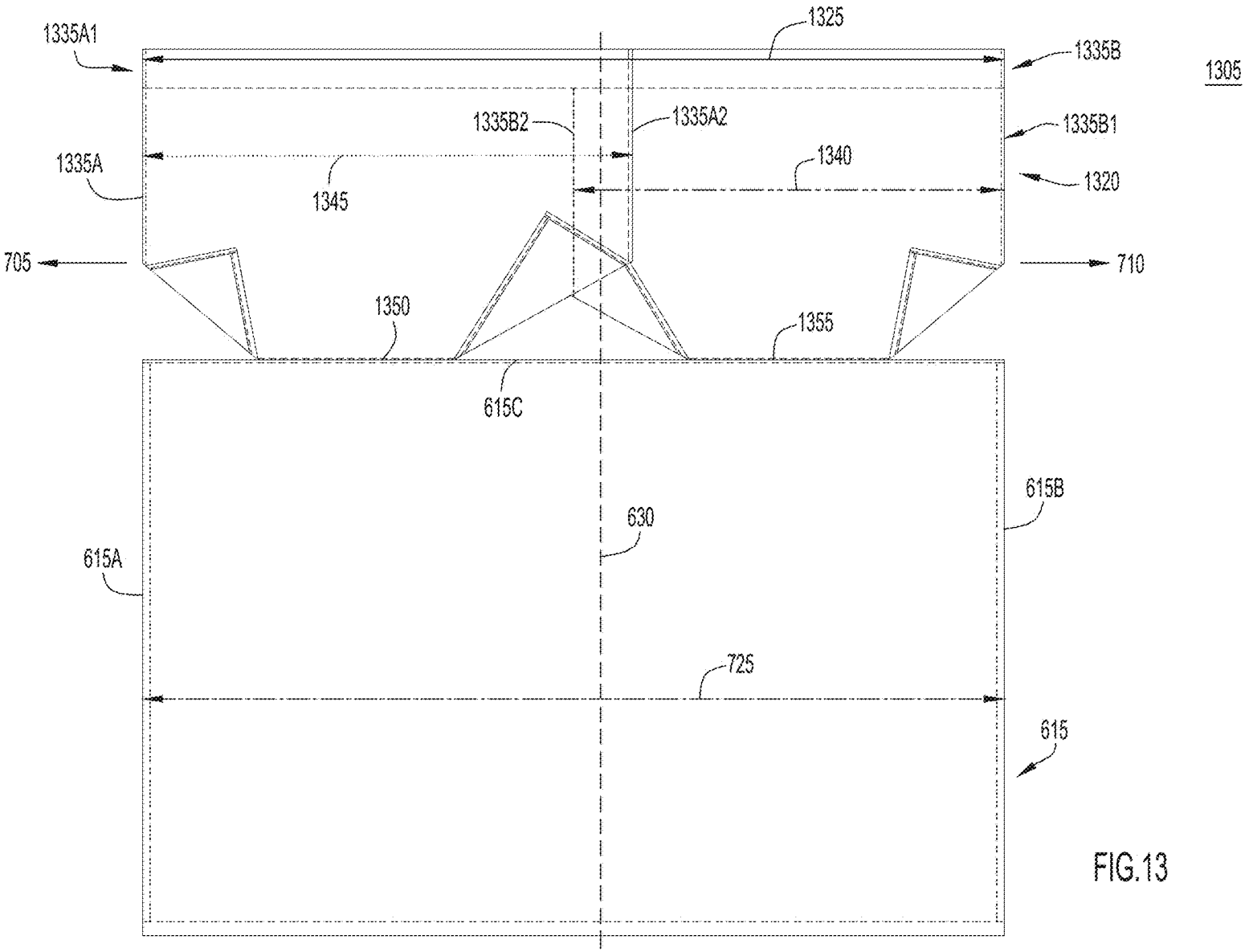
FIG. 13 is a top plan view of bedding, which includes multiple sets of flaps and has a substantially uniform total width, according to an example embodiment.

FIG. 13 is a top plan view of an article of bedding 1305, according to an alternative example embodiment. The bedding 1305 is substantially similar to the bedding 605 described above with reference to FIGS. 6-11, except that the bedding 1305 has a substantially uniform total width, i.e., a width 725 of the body portion 615 is substantially the same as a width 1325 of a flap portion 1320. The flap portion 1320 includes two sets of flaps 1335A and 1335B extending generally from the top end 615C of the body portion 615. Set 1335A includes a first end 1335A1 and a second end 1335A2 disposed opposite the first end 1335A1, with the end 1335A1 extending substantially away from the axis 630 of the body portion 615 in the first direction 705 and the end 1335A2 extending substantially away from the axis 630 in the second direction 710. Set 1335B includes a first end 1335B1 and a second end 1335B2 disposed opposite the first end 1335B1, with the end 1335B1 extending substantially away from the axis 630 in the second direction 710 and the end 1335B2 extending substantially away from the axis 630 in the first direction 705.

When the sets 1335A and 1335B are disposed in a regular, flat, unwrapped position (e.g., the position depicted in FIG. 13), ends 1335A2 and 1335B2 overlap one another, with one of the ends being disposed substantially on another of the ends. For example, as shown in FIG. 13, end 1335A2 can rest on end 1335B2, essentially nesting end 1335B2 behind end 1335A2. Alternatively, end 1335B2 can rest on end 1335A2, essentially nesting end 1335A2 behind end 1335B2. The degree of overlap of the sets of flaps 1335A and 1335B can vary. For example, when set 1335B has a flap width 1340 defined by ends 1335B1 and 1335B2, at least ten percent (10%) of that flap width 1340 can be covered when end 1335A2 rests on end 1335B2. Similarly, when set 1335A has a flap width 1345 defined by ends 1335A1 and 1335A2, at least ten percent (10%) of that flap width 1345 can be covered when end 1335B2 rests on end 1335A2. As may be appreciated, more or less than ten percent (10%) of the covered flap width (1340 or 1345, as applicable) can be covered in alternative example embodiments. For example, if each of the flap widths 1340 and 1345 is about sixty (60) inches, the flaps may overlap by at least six (6) inches, at least twelve (12) inches, or another amount.

As with the sets 635A and 635B described above with reference to FIGS. 6-11, each of the sets 1335A and 1335B is configured to be selectively wrapped around a second portion of a user's body. For example, a first user can rest their head on/under/over a middle portion 1350 of set 1335A and wrap (and unwrap) their face, head, neck, shoulders, and/or another portion of their body by selectively moving ends 1335A1 and 1335A2, while another user can rest their head on/under/over a middle portion 1355 of set 1335B and wrap (and unwrap) their face, head, neck, shoulders, and/or another portion of their body by selectively moving ends 1335B1 and 1335B2. Each of the sets 1335A and 1335B has a flap width (1345 and 1340, respectively) that is more than fifty percent (50%) of the body portion width 725 defined by side end (or edge) 615A and side end (or edge) 615B. For example, each of the flap widths 1345 and 1340 can be at least fifty-two percent (52%) or at least fifty-five percent (55%)—or some other value larger than fifty percent (50%)—of the body portion width 725. This way, even though the width 1325 of the flap portion 1320 is substantially the same as the width 725 of the body portion 615, each of the sets of flaps 1335A and 1335B can be wider than a width of the body portion 615 that may be allocated for use by a respective user (i.e., one-half of the body portion width 725). Thus, not only can each user have their own set of flaps (1335A or 1335B) with which to wrap themselves, but each of the sets of flaps 1335A and 1335B can provide even more material for wrapping than the user otherwise would have if the sets of flaps 1335A and 1335B had the same width as (or a lesser width than) a corresponding half of the body portion 615—all while maintaining a substantially uniform total width for the bedding 1305. For example, if the body portion 615 has a body portion width 725 consistent with a width of a standard king size sheet, i.e., about 108-110 inches, each of the flap widths 1345 and 1340 may be about sixty (60) to sixty-three (63) inches or some other value that is more than fifty-four (54) to fifty-five (55) inches (i.e., more than one-half the body portion width 725), while the total flap portion width 1325 may be the same as the body portion width 725.

As shown in FIG. 13, the set of flaps 1335A includes the middle portion 1350, that is attached, or integral, to the top end 615C of the body portion 615 and disposed substantially between the ends 1335A1 and 1335A2. Each of the ends 1335A1 and 1335A2 is unattached to the body portion 615, allowing freedom of movement by the ends 1335A1 and 1335A2 relative to the body portion 615. Similarly, the set of flaps 1335B includes the middle portion 1355, that is attached, or integral, to the top end 615C of the body portion 615 and disposed substantially between the ends 1335B1 and 1335B2. Each of the ends 1335B1 and 1335B2 is unattached to the body portion 615, allowing freedom of movement by the ends 1335B1 and 1335B2 relative to the body portion 615.

For example, each of the unattached ends 1335A1 and 1335A2 can constitute at least about twelve (12) inches of the flap width 1345 (with the middle portion 1350 having a length/width less than about thirty-nine (39) inches when the flap width 1345 is about sixty-three (63) inches), and each of the unattached ends 1335B1 and 1335B2 can constitute at least about twelve (12) inches of the flap width 1340 (with the middle portion 1355 having a length/width less than about thirty-nine (39) inches when the flap width 1340 is about sixty-three (63) inches), though lengths/widths can vary widely in different embodiments. Lengths of the unattached ends 1335A1, 1335A2, 1335B1, and 1335B2 can be the same as one another or different from one another. For example, unattached end 1335A1 can have a length of about fifteen (15) inches, middle portion 1350 can have a length of about twenty-five (25) inches, unattached end 1335A2 can have a length of about twenty-three (23) inches, unattached end 1335B2 can have a length of about twenty-three (23) inches, middle portion 1355 can have a length of about twenty-five (25) inches, and unattached end 1335B1 can have a length of about fifteen (15) inches. However, it should be appreciated that this configuration is illustrative and alternative configurations may be included in other example embodiments. For example, the lengths of the middle portions 1350 and 1355 that are attached, or integral, to the top end 615C, and the lengths of the unattached ends (1335A1, 1335A2, 1335B1, and 1335B2) may be larger or smaller in alternative embodiments.

In addition, the configurations of the body portion 615 and flap portion 1320, including respective sizes, shapes, and features of the body portion 615 and flap portion 1320, are illustrative and should not be construed as being limiting in any way. For example, while each of the body portion 615 and the flap portion 1320 has a substantially rectangular shape, it should be recognized that the body portion 615 and flap portion 1320 may have any of a variety of different shapes, which may be the same as, or different from, one another. For example, a shape and/or size of the flap portion 1320 may be modified to include an arced, scalloped, or other profile.

In summary, in one form, an article of bedding can include a body portion comprising a substantially elongated member configured to simultaneously extend substantially along a length of a first portion of a first user's body and a first portion of a second user's body when the first portion of the first user's body and the first portion of the second user's body are covered by, or covering, the body portion, the elongated member comprising a first side end, a second side end disposed opposite the first side end, a top end, and a bottom end disposed opposite the top end, the first side end and the second side end defining a body portion width, a central axis of the body portion extending through the body portion width, between the top end and the bottom end. A first set of flaps extends generally from the top end of the body portion, and a second set of flaps extends generally from the top end of the body portion. The first set of flaps is configured to be selectively wrapped and unwrapped around at least a second portion of the first user's body, and the second set of flaps is configured to be selectively wrapped and unwrapped around at least a second portion of the second user's body, when the first portion of the first user's body and the first portion of the second user's body are covered by, or covering, the body portion. When the first set of flaps and the second set of flaps are in an unwrapped position, a first end of the first set of flaps extends substantially away from the central axis in a first direction, a second end of the first set of flaps extends substantially away from the central axis in a second direction opposite the first direction, a first end of the second set of flaps extends substantially away from the central axis in the first direction, and a second end of the second set of flaps extends substantially away from the central axis in the second direction, the first end of the first set of flaps and the second end of the first set of flaps defining a first flap width, and the first end of the second set of flaps and the second end of the second set of flaps defining a second flap width, each of the first flap width and the second flap width being more than fifty percent (50%) of the body portion width. For example, each of the first flap width and the second flap width can be at least fifty-two percent (52%) or at least fifty-five percent (55%) of the body portion width, though other widths may be included in various embodiments.

In an example embodiment, the second end of the first set of flaps is configured to overlap the first end of the second set of flaps when the first set of flaps and second set of flaps are in the unwrapped position. For example, when the second end of the first set of flaps overlaps the first end of the second set of flaps in the unwrapped position, at least ten percent (10%) of the second flap width can be covered by the first set of flaps.

In addition, or in the alternative, the first set of flaps can include a first middle portion that is attached, or integral, to the top end of the body portion, and disposed between the first end of the first set of flaps and the second end of the first set of flaps, with each of the first end of the first set of flaps and the second end of the first set of flaps being unattached to the body portion; and the second set of flaps can include a second middle portion that is attached, or integral, to the top end of the body portion, and disposed between the first end of the second set of flaps and the second end of the second set of flaps, with each of the first end of the second set of flaps and the second end of the second set of flaps being unattached to the body portion. For example, the body portion can be integrally formed with each of the first set of flaps and the second set of flaps. Alternatively, each of the first set of flaps and the second set of flaps can be coupled to the body portion. For example, each of the first set of flaps and the second set of flaps can be selectively removable from the body portion.

In another form, an article of bedding can include a body portion comprising a substantially elongated member configured to simultaneously extend substantially along a length of a first portion of a first user's body and a first portion of a second user's body when the first portion of the first user's body and the first portion of the second user's body are covered by, or covering, the body portion, the elongated member comprising a first side end, a second side end disposed opposite the first side end, a top end, and a bottom end disposed opposite the top end, the first side end and the second side end defining a body portion width, a central axis of the body portion extending through the body portion width, between the top end and the bottom end. A first set of flaps extends generally from the top end of the body portion, and a second set of flaps extends generally from the top end of the body portion. The first set of flaps is configured to be selectively wrapped and unwrapped around at least a second portion of the first user's body, and the second set of flaps is configured to be selectively wrapped and unwrapped around at least a second portion of the second user's body, when the first portion of the first user's body and the first portion of the second user's body are covered by, or covering, the body portion. When the first set of flaps and the second set of flaps are in an unwrapped position, a first end of the first set of flaps extends substantially away from the central axis in a first direction, a second end of the first set of flaps extends substantially away from the central axis in a second direction opposite the first direction, a first end of the second set of flaps extends substantially away from the central axis in the first direction, and a second end of the second set of flaps extends substantially away from the central axis in the second direction, the first end of the first set of flaps and the second end of the first set of flaps defining a first flap width, and the first end of the second set of flaps and the second end of the second set of flaps defining a second flap width, the first set of flaps overlapping at least ten percent (10%) of the second flap width, each of the first flap width and the second flap width being more than fifty percent (50%) of the body portion width. For example, each of the first flap width and the second flap width can be at least fifty-two percent (52%) or at least fifty-five percent (55%) of the body portion width, though other widths may be included in various embodiments.

In an example embodiment, the first set of flaps includes a first middle portion that is attached, or integral, to the top end of the body portion, and disposed between the first end of the first set of flaps and the second end of the first set of flaps, each of the first end of the first set of flaps and the second end of the first set of flaps being unattached to the body portion, and the second set of flaps includes a second middle portion that is attached, or integral, to the top end of the body portion, and disposed between the first end of the second set of flaps and the second end of the second set of flaps, each of the first end of the second set of flaps and the second end of the second set of flaps being unattached to the body portion. The body portion may, for example, be integrally formed with each of the first set of flaps and the second set of flaps. Alternatively, each of the first set of flaps and the second set of flaps can be coupled to the body portion. For example. each of the first set of flaps and the second set of flaps can be selectively removable from the body portion.

In another form, an article of bedding includes a body portion comprising a substantially elongated member configured to simultaneously extend substantially along a length of a first portion of a first user's body and a first portion of a second user's body when the first portion of the first user's body and the first portion of the second user's body are covered by, or covering, the body portion, the elongated member comprising a first side end, a second side end disposed opposite the first side end, a top end, and a bottom end disposed opposite the top end, the first side end and the second side end defining a body portion width, a central axis of the body portion extending through the body portion width, between the top end and the bottom end. A first set of flaps includes a first flap end, a second flap end, and a first middle portion that is attached, or integral, to the top end of the body portion and disposed between the first flap end and the second flap end, each of the first flap end and the second flap end being unattached to the body portion. A second set of flaps includes a third flap end, a fourth flap end, and a second middle portion that is attached, or integral, to the top end of the body portion and disposed between the third flap end and the fourth flap end, each of the third flap end and the fourth flap end being unattached to the body portion. The first set of flaps is configured to be selectively wrapped and unwrapped around at least a second portion of the first user's body, and the second set of flaps is configured to be selectively wrapped and unwrapped around at least a second portion of the second user's body, when the first portion of the first user's body and the first portion of the second user's body are covered by, or covering, the body portion. When the first set of flaps and the second set of flaps are in an unwrapped position, the first flap end of the first set of flaps extends substantially away from the central axis in a first direction, the second flap end of the first set of flaps extends substantially away from the central axis in a second direction opposite the first direction, the third flap end of the second set of flaps extends substantially away from the central axis in the first direction, and the fourth flap end of the second set of flaps extends substantially away from the central axis in the second direction, the first flap end and the second flap end defining a first flap width, and the third flap end and the fourth flap end defining a second flap width, each of the first flap width and the second flap width being at least fifty-two percent (52%) of the body portion width. For example, each of the first flap width and the second flap width can be at least fifty-five percent (55%) of the body portion width, though other widths may be included in various embodiments.

In an example embodiment, the second flap end is configured to overlap the third flap end when the first set of flaps and second set of flaps are in the unwrapped position. For example, when the second flap end overlaps the third flap end in the unwrapped position, at least ten percent (10%) of the second flap width can be covered by the first set of flaps. The body portion may, for example, be integrally formed with each of the first set of flaps and the second set of flaps. Alternatively, each of the first set of flaps and the second set of flaps can be coupled to the body portion. For example. each of the first set of flaps and the second set of flaps can be selectively removable from the body portion.

Variations and Implementations

As used herein, unless expressly stated to the contrary, use of the phrase 'at least one of', 'one or more of', 'and/or', variations thereof, or the like are open-ended expressions that are both conjunctive and disjunctive in operation for any and all possible combination of the associated listed items. For example, each of the expressions 'at least one of X, Y and Z', 'at least one of X, Y or Z', 'one or more of X, Y and Z', 'one or more of X, Y or Z' and 'X, Y and/or Z' can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Additionally, unless expressly stated to the contrary, the terms 'first', 'second', 'third', etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, 'first X' and 'second X' are intended to designate two 'X' elements that are not necessarily limited by any order, rank, importance, temporal sequence, or hierarchy of the two elements. Further as referred to herein, 'at least one of' and 'one or more of can be represented using the'(s)' nomenclature (e.g., one or more element(s)).

One or more advantages described herein are not meant to suggest that any one of the embodiments described herein necessarily provides all of the described advantages or that all the embodiments of the present disclosure necessarily provide any one of the described advantages. Numerous other changes, substitutions, variations, alterations, and/or modifications may be ascertained to one skilled in the art and it is intended that the present disclosure encompass all such changes, substitutions, variations, alterations, and/or modifications as falling within the scope of the appended claims.

What is claimed is:

1. An article of bedding, comprising:

a body portion comprising a substantially elongated member configured to simultaneously extend substantially along a length of a first portion of a first user's body and a first portion of a second user's body when the first portion of the first user's body and the first portion of the second user's body are covered by, or covering, the body portion, the elongated member comprising a first side end, a second side end disposed opposite the first side end, a top end, and a bottom end disposed opposite the top end, the first side end and the second side end defining a body portion width, a central axis of the body portion extending through the body portion width, between the top end and the bottom end;

a first set of flaps extending generally from the top end of the body portion; and a second set of flaps extending generally from the top end of the body portion, wherein the first set of flaps is configured to be selectively wrapped and unwrapped around at least a second portion of the first user's body, and the second set of flaps is configured to be selectively wrapped and unwrapped around at least a second portion of the second user's body, when the first portion of the first user's body and the first portion of the second user's body are covered by, or covering, the body portion, and wherein, when the first set of flaps and the second set of flaps are in an unwrapped position, a first end of the first set of flaps extends substantially away from the central axis in a first direction, a second end of the first set of flaps extends substantially away from the central axis in a second direction opposite the first direction, a first end of the second set of flaps extends substantially away from the central axis in the first direction, and a second end of the second set of flaps extends substantially away from the central axis in the second direction, the first end of the first set of flaps and the second end of the first set of flaps defining a first flap width, and the first end of the second set of flaps and the second end of the second set of flaps defining a second flap width, each of the first flap width and the second flap width being more than fifty percent (50%) of the body portion width.

2. The article of bedding of claim 1, wherein the second end of the first set of flaps is configured to overlap the first end of the second set of flaps when the first set of flaps and second set of flaps are in the unwrapped position.

3. The article of bedding of claim 2, wherein, when the second end of the first set of flaps overlaps the first end of the second set of flaps in the unwrapped position, at least ten percent (10%) of the second flap width is covered by the first set of flaps.

4. The article of bedding of claim 1, wherein each of the first flap width and the second flap width is at least fifty-two percent (52%) of the body portion width.

5. The article of bedding of claim 1, wherein each of the first flap width and the second flap width is at least fifty-five percent (55%) of the body portion width.

6. The article of bedding of claim 1, wherein:

the first set of flaps comprises a first middle portion that is attached, or integral, to the top end of the body portion, and disposed between the first end of the first set of flaps and the second end of the first set of flaps, each of the first end of the first set of flaps and the second end of the first set of flaps being unattached to the body portion; and the second set of flaps comprises a second middle portion that is attached, or integral, to the top end of the body portion, and disposed between the first end of the second set of flaps and the second end of the second set of flaps, each of the first end of the second set of flaps and the second end of the second set of flaps being unattached to the body portion.

7. The article of bedding of claim 1, wherein the body portion is integrally formed with each of the first set of flaps and the second set of flaps.

8. The article of bedding of claim 1, wherein each of the first set of flaps and the second set of flaps is coupled to the body portion.

9. The article of bedding of claim 1, wherein each of the first set of flaps and the second set of flaps is selectively removable from the body portion.

10. An article of bedding, comprising:

a body portion comprising a substantially elongated member configured to simultaneously extend substantially along a length of a first portion of a first user's body and a first portion of a second user's body when the first portion of the first user's body and the first portion of the second user's body are covered by, or covering, the body portion, the elongated member comprising a first side end, a second side end disposed opposite the first side end, a top end, and a bottom end disposed opposite the top end, the first side end and the second side end defining a body portion width, a central axis of the body portion extending through the body portion width, between the top end and the bottom end; and a first set of flaps extending generally from the top end of the body portion; and a second set of flaps extending generally from the top end of the body portion, wherein the first set of flaps is configured to be selectively wrapped and unwrapped around at least a second portion of the first user's body, and the second set of flaps is configured to be selectively wrapped and unwrapped around at least a second portion of the second user's body, when the first portion of the first user's body and the first portion of the second user's body are covered by, or covering, the body portion, and wherein, when the first set of flaps and the second set of flaps are in an unwrapped position, a first end of the first set of flaps extends substantially away from the central axis in a first direction, a second end of the first set of flaps extends substantially away from the central axis in a second direction opposite the first direction, a first end of the second set of flaps extends substantially away from the central axis in the first direction, and a second end of the second set of flaps extends substantially away from the central axis in the second direction, the first end of the first set of flaps and the second end of the first set of flaps defining a first flap width, and the first end of the second set of flaps and the second end of the second set of flaps defining a second flap width, the first set of flaps overlapping at least ten percent (10%) of the second flap width, each of the first flap width and the second flap width being more than fifty percent (50%) of the body portion width.

11. The article of bedding of claim 10, wherein each of the first flap width and the second flap width is at least fifty-two percent (52%) of the body portion width.

12. The article of bedding of claim 10, wherein each of the first flap width and the second flap width is at least fifty-five percent (55%) of the body portion width.

13. The article of bedding of claim 10, wherein:

the first set of flaps comprises a first middle portion that is attached, or integral, to the top end of the body portion, and disposed between the first end of the first set of flaps and the second end of the first set of flaps, each of the first end of the first set of flaps and the second end of the first set of flaps being unattached to the body portion; and the second set of flaps comprises a second middle portion that is attached, or integral, to the top end of the body portion, and disposed between the first end of the second set of flaps and the second end of the second set of flaps, each of the first end of the second set of flaps and the second end of the second set of flaps being unattached to the body portion.

14. The article of bedding of claim 10, wherein the body portion is integrally formed with each of the first set of flaps and the second set of flaps.

15. The article of bedding of claim 10, wherein each of the first set of flaps and the second set of flaps is selectively removable from the body portion.

16. An article of bedding, comprising:

a body portion comprising a substantially elongated member configured to simultaneously extend substantially along a length of a first portion of a first user's body and a first portion of a second user's body when the first portion of the first user's body and the first portion of the second user's body are covered by, or covering, the body portion, the elongated member comprising a first side end, a second side end disposed opposite the first side end, a top end, and a bottom end disposed opposite the top end, the first side end and the second side end defining a body portion width, a central axis of the body portion extending through the body portion width, between the top end and the bottom end;

a first set of flaps comprising a first flap end, a second flap end, and a first middle portion that is attached, or integral, to the top end of the body portion and disposed between the first flap end and the second flap end, each of the first flap end and the second flap end being unattached to the body portion; and a second set of flaps comprising a third flap end, a fourth flap end, and a second middle portion that is attached, or integral, to the top end of the body portion and disposed between the third flap end and the fourth flap end, each of the third flap end and the fourth flap end being unattached to the body portion, wherein the first set of flaps is configured to be selectively wrapped and unwrapped around at least a second portion of the first user's body, and the second set of flaps is configured to be selectively wrapped and unwrapped around at least a second portion of the second user's body, when the first portion of the first user's body and the first portion of the second user's body are covered by, or covering, the body portion, and wherein, when the first set of flaps and the second set of flaps are in an unwrapped position, the first flap end of the first set of flaps extends substantially away from the central axis in a first direction, the second flap end of the first set of flaps extends substantially away from the central axis in a second direction opposite the first direction, the third flap end of the second set of flaps extends substantially away from the central axis in the first direction, and the fourth flap end of the second set of flaps extends substantially away from the central axis in the second direction, the first flap end and the second flap end defining a first flap width, and the third flap end and the fourth flap end defining a second flap width, each of the first flap width and the second flap width being at least fifty-two percent (52%) of the body portion width.

17. The article of bedding of claim 16, wherein the second flap end is configured to overlap the third flap end when the first set of flaps and second set of flaps are in the unwrapped position.

18. The article of bedding of claim 17, wherein, when the second flap end overlaps the third flap end in the unwrapped position, at least ten percent (10%) of the second flap width is covered by the first set of flaps.

19. The article of bedding of claim 16, wherein each of the first flap width and the second flap width is at least fifty-five percent (55%) of the body portion width.

20. The article of bedding of claim 16, wherein each of the first set of flaps and the second set of flaps is selectively removable from the body portion.

* * * * *